United States Patent [19]

Spangler et al.

[11] 4,227,683

[45] Oct. 14, 1980

[54] STACK HEIGHT SENSOR AND ELEVATOR CONTROL FOR A CONTINUOUS FORMS REFOLDER

[75] Inventors: Charles W. Spangler; Eugene S. Haymes, both of Waynesboro, Va.

[73] Assignee: General Electric Company, Waynesboro, Va.

[21] Appl. No.: 29,389

[22] Filed: Apr. 12, 1979

[51] Int. Cl.[3] ..... B65H 45/00

[52] U.S. Cl. ..... 270/61 F

[58] Field of Search ..... 270/61 R, 61 F, 39, 270/73, 79; 226/24

[56] References Cited

U.S. PATENT DOCUMENTS

| | | | |
|---|---|---|---|
| 3,735,975 | 5/1973 | Sukel et al. | 270/61 F |
| 3,829,080 | 8/1974 | Braen | 270/61 F |
| 4,054,283 | 10/1977 | Rayfield | 270/79 |

*Primary Examiner*—E. H. Eickholt

*Attorney, Agent, or Firm*—Michael Masnik

[57] ABSTRACT

Apparatus for sensing the height of a stack of fan-folded web being refolded, and controlling its elevation with respect to the arriving web to minimize misfolding.

7 Claims, 7 Drawing Figures

TIMER 1 STARTS WHEN LIGHT BEAM IS INTERRUPTED

TIMER 2 STARTS WHEN LIGHT BEAM IS REESTABLISHED

TIMER 3 STARTS WHEN MOTOR STARTS

STACK HEIGHT SENSOR AND ELEVATOR CONTROL FOR A CONTINUOUS FORMS REFOLDER

BACKGROUND OF THE INVENTION

This invention relates to refolding fan-folded webs into a stack and, in particular, to an arrangement for sensing the height of stack of fan-fold paper being refolded and controlling the elevation of the stack height to facilitate proper folding.

In data processing and communication applications, high speed printers are used to print the rapidly generated output of data processing machines. The medium on which printing generally is performed is "fan-folded", that is, it comprises an elongated web having transversely extending folds longitudinally spaced with alternate folds pointing in opposite directions. The web is taken into the printer from a stack within which it is tightly folded at the spaced folds. In the course of printing the web is unfolded and a need exists to refold it along its folds in a zigzag manner and into a stack. The web may be a single sheet of paper or consist of several sheets of paper interspersed with carbons. It is not uncommon to print up to several sheets with carbons.

It should be noted that the output of a high speed printer is not necessarily continuous and constant. The printer will generate printout faster when printing short lines than long ones. When slewing (feeding paper without printing), the paper moves through the printer at a extremely high speed. Further with some types of printers, paper is fed from the printer discretely and only after a line has been printed. No paper movement occurs during printing, that is the printer's paper output is not continuous.

Machines have been designed to stack the fan-folded printout from high speed printers. Oftentimes, a pair of paper feed tractors engage edge perforations in the paper and are used to feed the paper from its incoming stack through the printing mechanism and then to the outgoing stack being formed on a platform. The paper exiting from the printing mechanism is directed above the platform and caused to fall controllably into a stack on the platform. A particularly useful stacker is described in copending application of John R. Bittner, Harry R. Berrey and Ralph S. Billings entitled "Continuous Forms Refolder For High Speed Printers", U.S. Ser. No. 29,390 filed concurrently with this application on April 12, 1979 and assigned to a common assignee. This stacker employs an elevator which receives the paper from the printer and has provisions for driving said received paper longitudinally toward the platform. The elevator is designed to be automatically movable relative to the platform during the stacking operation so that a desired range of space is maintained between the elevator and the top of the stack of paper being folded on the platform. The maintaining of this proper spatial relationship results in an improved refolding of the paper on the platform. Reference can be made to this copending application for details of the improved refolding action and how it is achieved.

A need exists for an arrangement which can control such a range of spacing automatically and recurrently. A common approach is to employ an array of radiant energy sensors, such as photoelectric sensors, to sense the top of the stack of paper. The sensing operation is made difficult because of paper fluffing which occurs at the folded ends of the forms and does not represent the true height of the stack. Ambient light, dark leakage current and momentary light interruptions can result in a misreading of stack height. These and other problems to be described have made it difficult to provide a reliable, low cost, inexpensive device for sensing the height of a stack and controlling desirable spacing of the elements in a continuous forms refolder for a high speed printer.

SUMMARY OF THE INVENTION

It is an object of this invention to provide an improved stack height sensor for a fan-folded web which is reliable as well as inexpensive and easily maintained.

It is a further object of this invention to provide an improved apparatus for sensing the height of a fan-folded web and controlling its elevation over a wide range of stack heights.

It is a further object of this invention to provide an improved stack height sensor and elevator for a fan-folded web which automatically adjusts in height to accommodate different speeds and volume of fan-folded paper for stacking following printing.

It is a further object of this invention to provide an improved arrangement for sensing the height of a stack of fan-folded paper, such as emanating from a high speed printer, and for controlling its elevation for stacking.

In accordance with one embodiment of the invention there is provided a stack height sensor and elevator control for a continuous fan-fold paper refolder wherein an elevator receives the unfolded paper coming from a source and drives it longitudinally toward the platform on which the paper is to be stacked. A motor is provided for changing the elevator height to maintain a range of desired spacing between the height of the stack of paper being refolded on a platform and the elevator. This range of desired spacing is important from the standpoint of insuring proper refolding action. A sensor is mounted on the elevator for sensing the build-up of the stack height until it reaches a predetermined distance with respect to the elevator to produce a first control signal. A first timer is provided which responds to this first control signal for starting the motor after a predetermined time interval to raise the elevator. A second timer is made responsive to the sensed height falling below said predetermined distance below the elevator to stop the motor after a predetermined second time interval. A third timer is made responsive to the sensed height of the stack not falling below said predetermined interval after a predetermined time interval for stopping the motor.

Means are provided for making these timers variable in the time that they time out, to take care of different paper feed rates, stiffness and thickness of paper being refolded and the existance of differing stacks of paper volume in the refolder in the course of intermittent printing cycles.

DESCRIPTION OF THE PREFERRED EMBODIMENT

Figure 1:
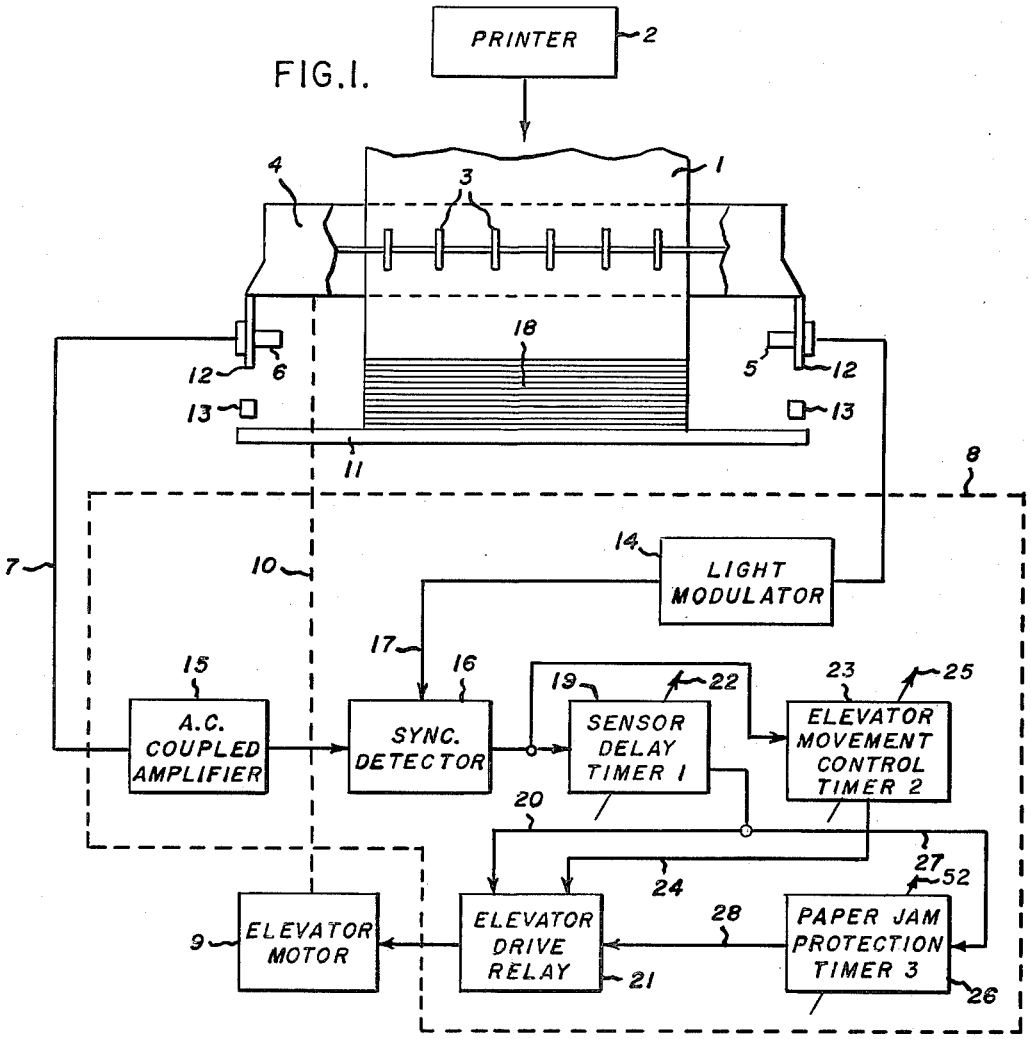
FIG. 1 illustrates in part schematic and part diagram form one embodiment of the present invention for sensing the height of fan-fold paper being stacked and controlling the elevation of the top of the stack height from an elevator from which the unfolded paper is arriving.

In the previously mentioned copending application Ser. No. 29,390 assigned to the common assignee, reference was made to an arrangement for refolding of continuous forms as the printed forms exit from a source such as a line printer at high speed. This copending application explains how if the refolding action takes place over too great a span of paper or over too short a span, misfolding can take place. By maintaining an optimum range of spacing between the top of the stack of paper being refolded and the source from which the unfolded paper is being received, in this particular case an elevator, misfolding can be minimized substantially. In this arrangement the elevator comprises a paper feed roller structure for feeding the paper toward the platform on which it is to be stacked. FIG. 1 illustrates an arrangement for photoelectrically sensing the height of the stack of paper being collected on a platform and for automatically adjusting the relative spacing between the top of the stack of paper and the paper feed roller structure to maintain a predetermined range of spacing between the rollers and the top of the forms stack. The incoming paper 1 available from a source such as a high speed printer 2 is passed between a plurality of pairs of pinch or feed rollers 3. In a particular embodiment, the pinch rollers were driven by an AC electric motor operating at a constant speed. The speed was selected such that the linear velocity of the contact surface of the rollers is always greater than the linear velocity of the paper being delivered from the printer 2. This permits the refolder to be automatically adaptable to any printer slew rate up to a predetermined limit without any need to synchronize the refolder to the particular printer. It also serves to maintain tension in the span of paper between the printer and the refolder. For safety reasons and others, the pinch rollers were designed to frictionally engage the drive shaft coupled to the motor so that the rollers spin against the paper when the paper is not moving. The roller system as described is mounted on an elevator 4. It contains a light source 5 and a photocell detector 6. This sensor array is intended to sense the top of the stack of forms in the tray. The light beam is directed across the center of the stack of forms and is located intermediate to the successive folds on the stack. This position of the light beam will provide the best indication of true stack height since it is least affected by the fluffing-up that occurs at the folded ends of the forms. When the forms stack increases to the point where the light beam is broken, the signal developed by detector 6, applied over lead 7 to control circuitry 8, is used to cause the elevator motor 9 mechanically coupled by 10 to the elevator 4 to raise the elevator structure a predetermined distance. The light beam will be re-established after the elevator moves since the light source and detector are attached to the elevator structure. The elevator structure is designed to move up in equal increments each time the light beam is interrupted by the top of the form stack. This maintains desired range of spacing between the rollers and the stack which is necessary for reliable stacking.

Figure 2A:
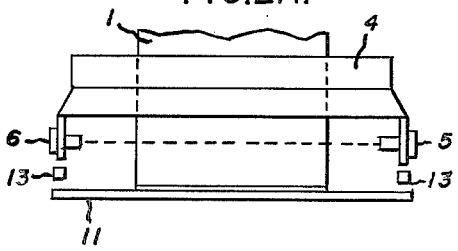
FIGS. 2A–2C illustrate schematically certain steps of the process carried out by the device shown in FIG. 1, and certain relationships involved in carrying out the process.
Figure 2B:
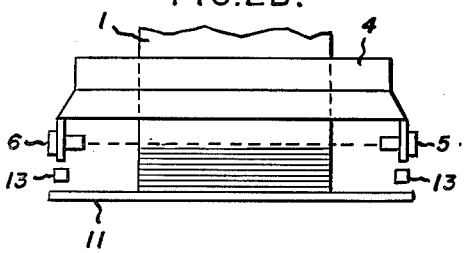

It might be helpful at this time to describe how the apparatus of FIG. 1 is operated to produce the desired results. A length of fan-fold paper is drawn by hand past the friction rollers 3 and arranged such that at least one fold of the paper is oriented on the platform 11 in an area, for example, designated by markings on which subsequent folds are to be stacked. The elevator 4 is manually descended until the lower end 12 of the elevator strike the stops 13 attached to the main frame of the refolder mechanism. At this point the distance between the elevator rollers and the platform is at an optimum height and in one embodiment was designed to be substantially half the length of the web between successive folds. This is shown in FIG. 2A. Successive fan-folds of the paper coming from the rollers 3 fall onto the stack and cause its height to increase. When the height of the stack interrupts the light beam as shown in FIG. 2B, control circuit 8 to be described operates to cause a motor 9 to raise the elevator 4. It should be noted that the motor driving the rollers had previously been activated to cause the rollers 3 to rotate. In the absence of any feeding of paper from the printer 2 because of clutch action, the rollers would normally slip on the fan-fold paper. When the printer is engaged and the fan-fold paper is driven longitudinally toward the rollers 3, as for example by a tractor arrangement which engages edge punched holes in the fan-fold paper, the rollers 3 pull the fan-fold paper and push it toward the platform 11. As the stack of forms on the platform 11 builds up to where the light source 5 is interrupted by the height of the stack, the photodetector 6 operates through control circuitry 8 to cause motor 9 to raise the elevator a predetermined distance. In a particular embodiment, this increased distance was of the order of one-half inch per elevation movement which is substantially smaller than the distance between successive folds of the fan-fold paper.

The control action to be provided by circuitry 8 can be summarized as follows. In order to energize the light source 5, there is provided a light modulator 14. The light modulator which will be described in great detail shortly, is used to turn a light source on and off at a very fast rate, in the order of 7.5 kilohertz. By utilizing a modulated light beam at this high frequency the adverse effects of ambient light and dark leakage current can be eliminated. The light from source 5 intercepted by detector 6 produces a very low level current pulsating at the modulating frequency. This signal is amplified by the AC coupled amplifier 15 and applied to the sync detector 16. The sync detector 16 is synchronized by lead 17 with the modulator 14 such that it will pass the modulation frequency to the subsequent circuits and block all other frequencies. This eliminates any extraneous signals from the photodetector resulting from ambient light or dark leakage. As previously mentioned, when the light beam supplied by source 5 is interrupted by the top of the form stack 18, the elevator 4 is designed to move upward provided certain conditions are met. Under normal operation sensor timer 19 responds to an interrupted light beam signal available from 16 to start timing out and supply a time delayed signal over lead 20 to the elevator drive relay 21 for energizing the elevator motor 9 after a first predetermined time interval. Thus timer 19 will prevent the elevator from moving up until the light beam has been interrupted for a preset time. If the light is reestablished before the preset time, the timer is reset and made available for responding to the next light interruption. This preset time delay is necessary to make sure that the elevator moves when the light beam is interrupted by the actual top of the stack and not as a result of momentary light beam interruptions. These momentary interruptions can be caused by each sheet of the continuous forms paper as they are folding on the top of the stack. The delay time will be determined by the paper feed rate into the rollers 3. In one application this delay time was established at one and one-half seconds. Arrow 22 indicates that the timer 19 is adjustable to provide different time delays to take care of different paper feed rates.

The elevator movement control establishes the distance that the elevator raises up each time the light beam is interrupted by the top of the form stack. This is done by controlling the on time of the elevator drive motor by a timer 23. The longer the motor remains on, the greater the distance moved by the elevator. Timer 23 responds to a signal from 16 indicating that the light beam has been reestablished for providing a time-delayed signal over lead 24 to the elevator drive relay 21 to stop the elevator motor 9. In a particular embodiment, the time delay for timer 23 was also established to be one and one-half seconds which resulted in half inch incremental height adjustments for the elevator. Control timer 23 is shown to be adjustable by arrow 25 to accommodate differences in the stiffness and thickness of paper which will allow desired changes in the incremental height adjustments.

If the light beam is not re-established when the elevator moves up the predetermined increment, it will continue to move up until the obstruction is cleared. However in the event that a paper jam or other malfunction should occur, the elevator could raise to its top limit and continue to drive against the mechanical stop. Prolonged operation under this condition would damage the drive mechanism shown as dotted line 10 for the elevator 4. In the aforementioned application, the drive mechanism 10 constituted a capstan drive motor operating through cables for controlling the elevator height. Paper jam protection timer 26 responds to a signal available from timer 19 on lead 27 indicating that the elevator motor is started for generating a signal after a predetermined time delay for turning the motor 9 off by a signal applied over lead 28 in the event the light beam is not re-established during this last named time delay. In a particular embodiment this time delayed signal was elected to be six and one-half seconds after the motor 9 had been started by the operation of timer 19. Timer 26 is made adjustable as shown by arrow 52 to accommodate different stacks of paper volume existing on the platform during intermittent printing cycles and to provide protection against jamming.

Figure 2C:
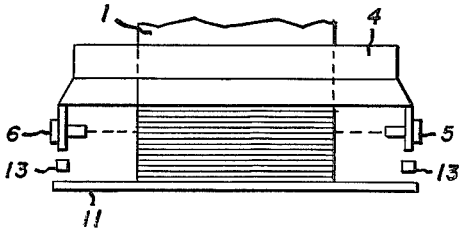
Figure 3:
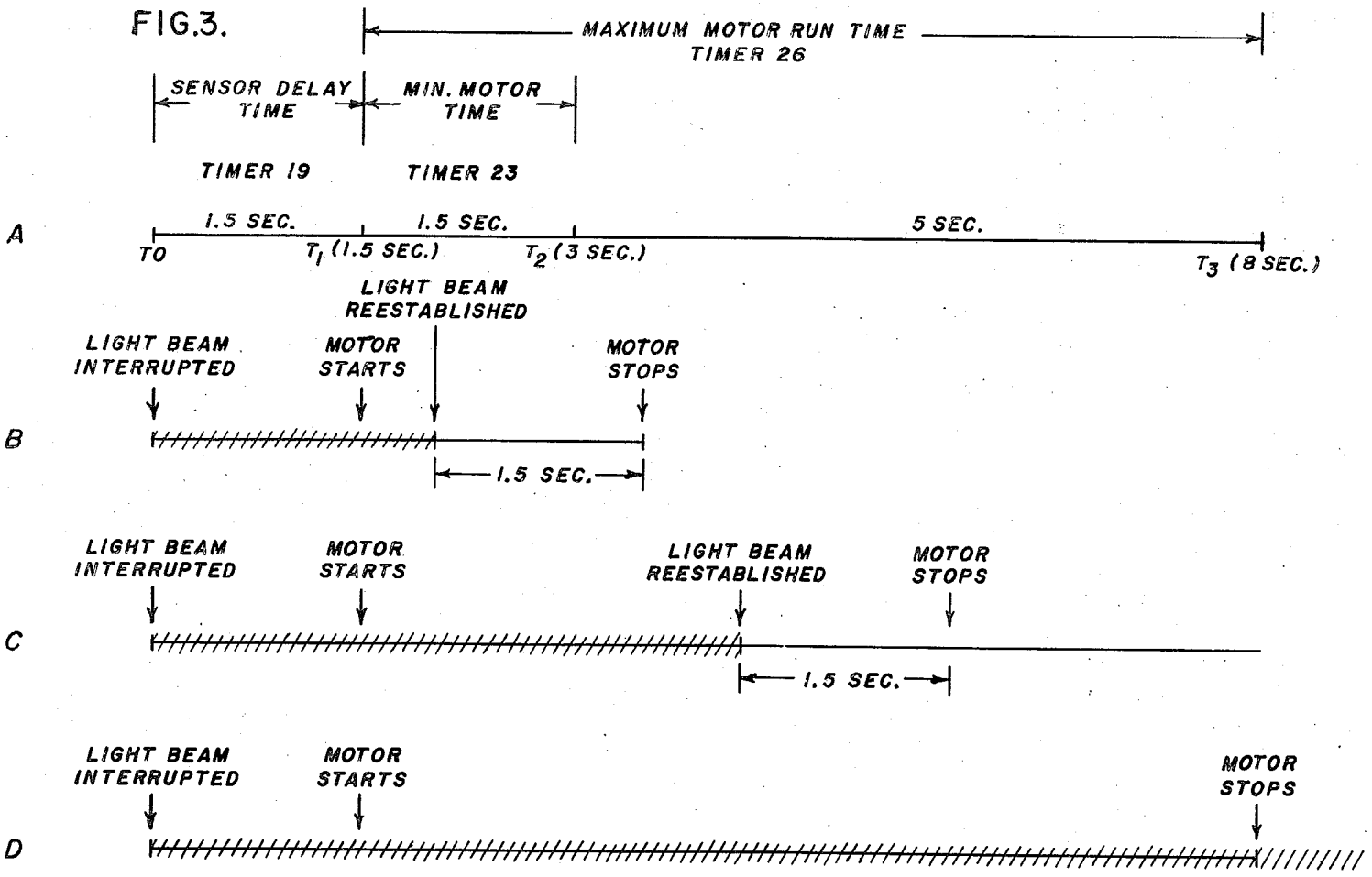
FIG. 3 illustrates graphically certain timing events useful in explaining the operation of the present invention and FIGS. 4 and 5 are circuit diagrams of embodiments of the present invention useful in carrying out the functions illustrated graphically in FIG. 3.

Referring to FIG. 3, there is illustrated graphically the various timing sequences involved in the operation of the control circuit 8 of FIG. 1. In these graphs the occurrence of an event is plotted as the ordinate and time as the abscissa. FIG. 3A shows the time-out periods for each of the timers 19, 23 and 26. Referring to FIG. 3B, if the light beam is interrupted by the stack height blocking the light passage from source 5 to detector 6, the motor 9 is started after the timer 19 times out after one and one-half seconds. After the light beam is re-established motor 9 is stopped by the timing out of timer 23 after one and one-half seconds. In one particular application the starting and stopping of the motor resulted in an incremental raising of the elevator by one-half inch. FIG. 3C shows the abnormal condition when the refolding process is started with a partial stack of paper on the platform. This event is illustrated in FIG. 2C. In this instance the light beam would remain interrupted for a longer period than that illustrated in FIG. 3B because of the initial partial stack of paper on the platform. However, once the light beam is re-established when the sensors can detect across the top of the stack, timer 23 will stop the motor after a predetermined time interval following the re-establishment of the beam. It should be noted that the motor in the instance of FIG. 3C repositions the elevator by the same spacing above the top of the stack as in the case of FIG. 3B. In the event the light beam is interrupted as in the case of a paper jam or the chamber for receiving paper is filled with stacked paper on the platform, FIG. 3D illustrates graphically how this is resolved. Upon the light beam being interrupted the motor 9 is started as in FIGS. 3B and 3C. Timer 26 operates to generate a time delayed signal a predetermined time after the motor start condition to stop the motor in the event the light beam is not reestablished in the period between the time the motor starts and the timer 26 times out. In a given application, this predetermined time was selected to be 6.5 seconds after the motor start condition.

Figure 4:
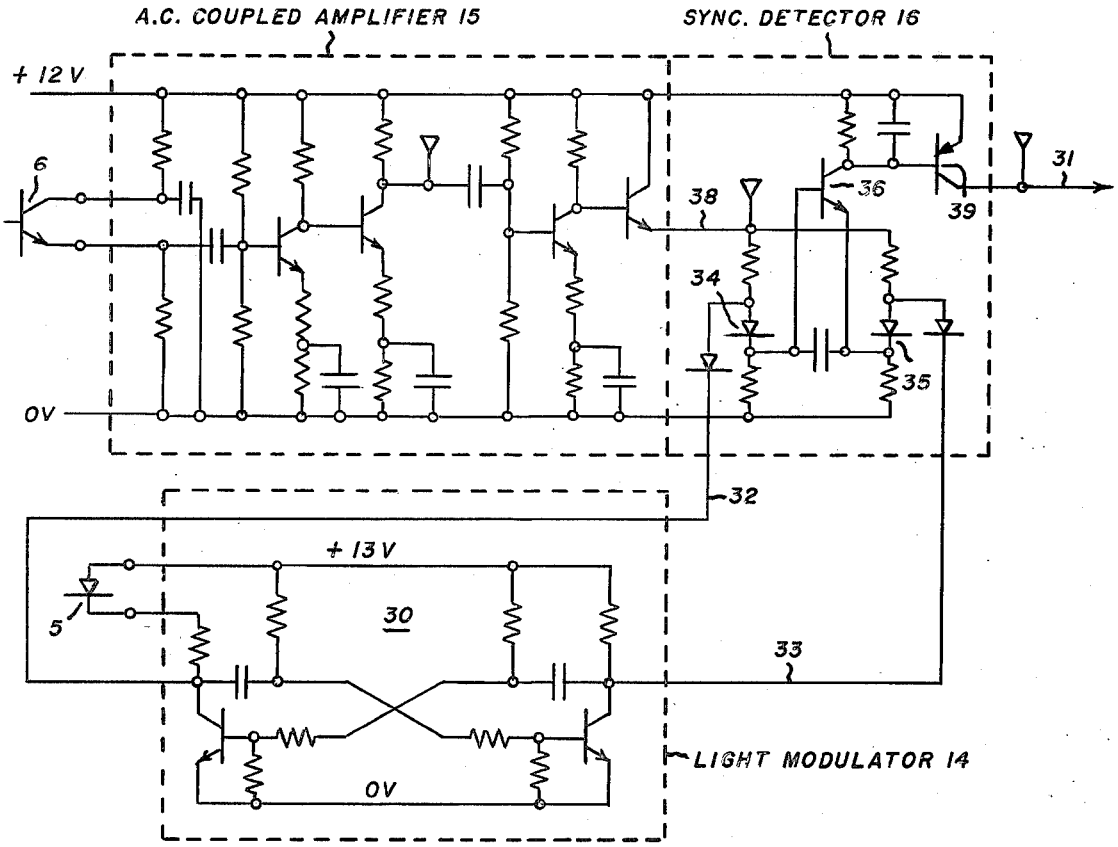

Reference can now be made to FIG. 4 which illustrates the circuit diagram of an AC coupled amplifier 15, light modulator 14 and synchronized detector 16. The light modulator comprises a flip-flop 30 which chops the 13 volt power supplied to its transistors in accordance with the time constants established by the capacitors and resistors of the flip-flop to produce a pulse current in a particular embodiment of 7.5 kilohertz. This pulse current is applied to the light source 5 which may be an infrared LED or similar device. When there is no blockage of the light beam available from source 5, the radiant energy is received by photodetector 6 amplified in AC amplifier 15 and applied to synchronized detector 16 to produce a signal on the output lead 31 indicating that light has been received by detector 6. Since the output of the photodetector is a very low level current, pulsating at the modulating frequency, it is amplified by the three stages of AC coupled amplifiers and sent through an emitter follower to the input of the synchronized detector 16. Detector 16 has the output from the two stages of the flip-flop 30 applied over respective leads 32 and 33 to diode gates 34 and 35 of detector 16. If the light beam from 5 is detected by 6, amplified in the amplifier 15, it appears on the common input lead 38 to the gates 34 and 35. Diode 34 gates the amplified photodetector signal to the base of transistor 36 and diode 35 gates this signal to the emitter of transistor 36. In a particular embodiment, the signal on lead 38, during the period when the detector is detecting the light beam available from 5, was a signal alternating at the frequency of the flip-flop 30 and swinging $\pm 3$ volts with respect to a 6 volt level. Under those circumstances transistor 36 would conduct turning on transistor 39. The signal on lead 31 resulting from the conduction of 39 causes condensor 40 of timer 19 in FIG. 5 to be discharged such that there is no signal to control the motor 9. When the beam of light from 5 is interrupted by a stack of paper, the detector 6 detects no incoming light beam and the signal on 38 would be at the 6 volt DC level. Under those circumstances transistors 36 and 39 would not conduct, indicating a no light condition on output lead 31. It is this no light condition which is used to control the operation of motor 9.

Figure 5:
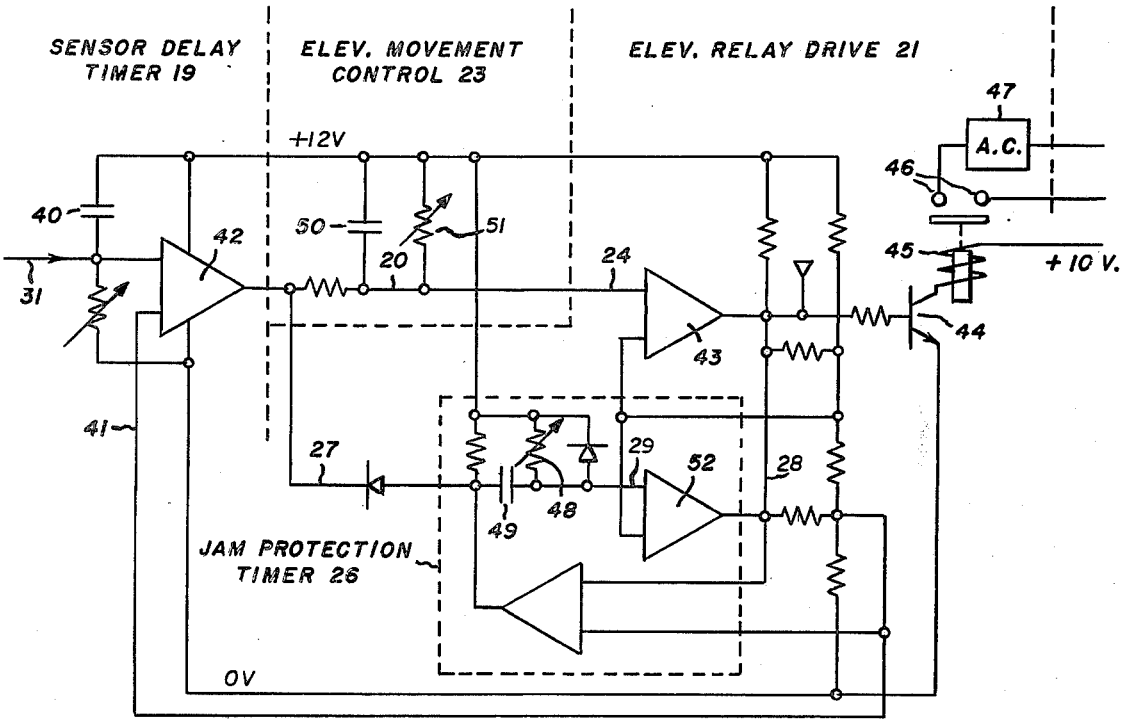

Referring to FIG. 5, the no light signal on detector 16 causes condensor 40 to charge up, which causes the voltage on lead 31 to drop. When the voltage on lead 31 drops to where it approaches the signal level on lead 41 of comparator 42, comparator 42 switches from a high voltage to a low voltage level producing a low voltage signal on lead 20. The time it takes the signal on lead 31 to reach the level causing switchover of 42 depends on the charging rate of condensor 40 and represents the delay time of timer 19. This low level signal on lead 20 is applied to one input of comparators 43 and 52 which causes their output to switch to a high level turning on transistor 44 and causing coil 45 to operate contacts 46 applying power from AC source 47 to motor 9. The signal on lead 20 resulting in turning the motor 9 on, also causes the jam protection timer 26 to start timing out. If the light remains interrupted, since there is no light signal on input lead 31, timer 26 continues to time out in accordance with the time constant of resistor 48 and condenser 49. When signal at the input lead 29 of comparator 43 reaches a given high level, comparator 43 switches causing the output of 52 to drop turning off transistor 44 and thereby removing power and stopping the motor 9. If before the jam protection timer 26 times out, the light beam is re-established by a light signal on lead 31. The conduction of transistor 39 causes capacitor 40 to discharge abruptly. The resulting rise in voltage causes the comparator 42 to switch its output to a high level allowing capacitor 50 to discharge into resistor 51. The time constants of 50 and 51 are selected such that upon discharge, a signal is developed on lead 24 which rises sufficiently to cause the comparator 43 to switch and produce a low level output signal which turns off transistor 44 and hence stops motor 9.

While the invention has been described with particular reference to the construction shown in the drawings, it is understood that further modifications may be made without departing from the true spirit and scope of the invention which is defined by the claims appended hereto.

What we claim as new and desire to secure by Letters Patent of the United States is:

1. A stack height sensor and elevator control for a continuous fan-fold paper refolder wherein an elevator receives the unfolded paper coming from a source and drives it longitudinally toward a platform on which the paper is to be stacked, a motor for driving the elevator to maintain a range of desired spacing between the height of the stack of paper refolded on the platform and the elevator, a first timer responsive to the buildup of the stack height to a predetermined minimum distance with respect to the elevator for starting the motor after a first predetermined first time interval to start raising the elevator toward a predetermined maximum distance with respect to said stack height, a second timer responsive to said stacked height attaining a predetermined intermediate distance with respect to said elevator which is a function of said first time interval to stop the motor after a predetermined second time interval, a third timer responsive to said stacked height not attaining said intermediate level after a predetermined third time interval for stopping said motor.

2. A stack height sensor and elevator control for a continuous fan-fold paper refolder wherein an elevator receives the unfolded paper coming from a source and drives it longitudinally toward a platform on which the paper is restacked, a motor for driving the elevator to maintain a range of desired spacing between the height of the stack and the elevator, a radiant energy emitter and detector mounted on said platform for sensing the stack height to produce a first signal indicating radiant energy interruption by said stacked height, a first timer responsive to said first signal for starting the motor after a first predetermined time interval to start raising the elevator, a second timer responsive to re-establishment of radiant energy to stop the motor after a predetermined second time interval, and a third timer responsive to non-re-establishment of radiant energy after a predetermined third time interval to stop the motor.

3. An arrangement according to claim 2 further comprising means for accommodating different paper feed rates comprising said first timer being adjustable to time out after selectively different time intervals.

4. An arrangement according to claim 2 comprising means for accommodating different stiffnesses and thicknesses of paper by permitting desired changes in the incremental height adjustments of the elevator comprising said second timer being adjustable to time out after selectively different time intervals.

5. An arrangement according to claim 2 further comprising means for accommodating different stacks of paper volume exiting on the platform during intermittent printing cycles and to provide protection against jamming comprising said third timer being adjustable to time out after selectively different time intervals.

6. An arrangement according to claim 2 wherein said third time interval is greater than said second time interval.

7. A stack height sensor and elevator control for a continuous fan-fold paper refolder wherein an elevator receives the unfolded paper coming from a source and drives it longitudinally toward a platform on which the paper is to be stacked, a motor for driving the elevator to maintain a range of desired spacing between the height of the stack of paper refolded on the platform and the elevator, a sensor mounted on the elevator for sensing the buildup of the stack height to a predetermined minimum distance with respect to the elevator to produce a first signal, a first timer responsive to said first signal for starting the motor after a first predetermined first time interval to start raising the elevator toward a predetermined maximum distance with respect to said stack height, a second timer responsive to said stacked height attaining a predetermined intermediate distance with respect to said elevator which is a function of said first time interval to stop the motor after a predetermined second time interval, a third timer responsive to the sensed height of the stack not attaining said intermediate level after a predetermined third time interval for stopping said motor.

* * * * *